US007350506B2

(12) United States Patent
Maezuru et al.

(10) Patent No.: US 7,350,506 B2
(45) Date of Patent: Apr. 1, 2008

(54) VARIABLE STROKE PROPERTY ENGINE

(75) Inventors: Akinori Maezuru, Wako (JP); Koichi Ikoma, Wako (JP); Kenji Abe, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 182 days.

(21) Appl. No.: 11/280,820

(22) Filed: Nov. 17, 2005

(65) Prior Publication Data

US 2006/0102116 A1 May 18, 2006

(30) Foreign Application Priority Data

Nov. 18, 2004 (JP) ..... 2004-334107
Nov. 18, 2004 (JP) ..... 2004-334110

(51) Int. Cl.
*F02B 75/04* (2006.01)
*F02B 75/32* (2006.01)

(52) U.S. Cl. ..... 123/461; 123/78 E; 123/197.4

(58) Field of Classification Search ..... 123/78 E, 123/78 F, 78 A, 48 B, 197.4
See application file for complete search history.

(56) References Cited

U.S. PATENT DOCUMENTS 1,870,139 A * 8/1932 Pierotti ..... 123/65 VA
2,314,789 A * 3/1943 Jacobsen ..... 123/197.4

FOREIGN PATENT DOCUMENTS

| | | |
|---|---|---|
| JP | 09-228858 | 9/1997 |
| JP | 2004-138229 | 5/2004 |
| JP | 2004-150353 | 5/2004 |

* cited by examiner

*Primary Examiner*—Stephen K. Cronin
*Assistant Examiner*—Hyder Ali
(74) *Attorney, Agent, or Firm*—Arent Fox LLP

(57) ABSTRACT

Provided is a variable stroke property engine that can prevent an increase in the resistance to the engine owing to the contact between the variable stroke piston mechanism and lubricating oil. In a variable stroke property engine equipped with a variable piston stroke mechanism consisting of a plurality of links 4, 5 and 12, a baffle plate 40 is provided between the links and the oil surface of the lubricating oil received in an oil pan so that the links may be separated from the oil surface by the baffle plate and the lubricating oil is prevented from contacting the links. Thereby, an increase to the resistance to the movement of the links can be avoided.

12 Claims, 9 Drawing Sheets

VARIABLE STROKE PROPERTY ENGINE

TECHNICAL FIELD

The present invention relates to a variable stroke property engine, and in particular to a variable stroke property engine that can control an increase in the resistance owing to the contact between a variable stroke piston mechanism and lubricating oil in the oil pan.

BACKGROUND OF THE INVENTION

Variable stroke property engines comprising a plurality of links provided between the piston and crankshaft for varying the stroke of the piston by moving an end of one of the links that is connected to the engine main body are proposed in Japanese patent laid open publications Nos. 9-228858, 2004-138229 and 2004-150353.

It is known that the resistance to the engine increases if the crankshaft contacts the lubricating oil in the oil pan. Particularly in the case of a variable stroke property engine, because there are a large number of moving parts such as links that move about within the crankcase, the contact between the lubricating oil and such moveable parts is more problematic that that in more conventional fixed stroke engines in which the piston and crankshaft are connected to each other simply by a connecting rod (single link).

It is also know to provide a baffle plate above the oil surface of the lubricating oil to control the disturbance in the oil surface and prevent excessive splashing of lubricating oil onto the crankshaft. However, in the case of an engine incorporated with a variable stroke piston mechanism including a plurality of links, providing a special baffle plate for preventing the splashing of lubricating oil onto the variable stroke piston mechanism leads to an increase in the number of component parts and the amount of manufacturing work.

Also, the cylinder block of an engine is provided with passage for communicating the interior of the cylinder head with the interior of the crankcase for the purpose of returning the lubricating oil that has lubricated the valve actuating mechanism to the oil pan and to reduce the pressure pulsation in the crankcase.

In a conventional fixed stroke engine using only a connecting rod (single link) to connect the piston with the crankshaft, it is possible to avoid the return lubricating oil and blowby gas from contacting the crankshaft simply by forming a passage in a peripheral part of the cylinder. However, in a variable stroke property engine, because the variable piston stroke mechanism includes a large number of moving parts including a plurality of links, it is difficult to prevent the lubricating oil from dripping onto the links and thereby increasing the resistance to the movement or from obstructing the flow of the blowby gas. In particular, because the second link which connects the first link with the crankshaft moves at a high speed, splashing or dripping of lubricating oil onto the second link has a significant effect on the resistance to the movement thereof.

BRIEF SUMMARY OF THE INVENTION

In view of such problems of the prior art, a primary object of the present invention is to provide a variable stroke property engine that can prevent an increase in the resistance to the engine owing to the contact between the variable stroke piston mechanism and lubricating oil without increasing the number of component parts and the amount of manufacturing work.

A second object of the present invention is to provide a variable stroke property engine that can prevent a lubricating oil return passage or a crankcase ventilating passage from interfering with the variable piston stroke mechanism.

A third object of the present invention is to provide a variable stroke property engine that includes balancer shafts and variable stroke piston mechanism incorporated in the in a favorable layout.

According to the present invention, at least some of such objects can be accomplished by providing a variable stroke property engine comprising a variable piston stroke mechanism including a plurality of links, wherein: a baffle plate is provided between the links and an oil surface of lubricating oil received in an oil pan. Because the baffle plate prevents the lubricating oil from contacting the moveable parts such as links, the resistance to such moveable parts can be minimized.

The variable stroke property engine is typically provided with a control shaft extending parallel with the crankshaft and supported by a crankcase of the engine via at least a pair of holders for adjusting a position of one of the links, the baffle plate being formed by a connecting portion connecting the holders such as bearing caps with each other. Because the connecting portion connecting the control shaft holders with one another also serves as a baffle plate that prevents the lubricating oil from contacting the links and control shaft, an increase in the resistance due to the lubricating oil contacting the variable piston stroke mechanism can be avoided without providing a separate baffle plate or increasing the number of components or the amount of manufacturing work. Also, the connecting member increases the rigidity of the control shaft holders by connecting the control shaft holders with one another so that the support rigidity for the control shaft and third link can be increased. Preferably, the connecting portion is provided with a shape of curved plate having a convex surface facing an oil surface of lubricating oil received in an oil pan so that the disturbance owing to the splashing of the lubricating oil may be minimized.

According to a preferred embodiment of the present invention, the links include a first link connected to a piston, a second link connecting the first link to a crankshaft and a third link having an end connected to the second link and another end movably supported by the control shaft.

The engine may further comprise a balancer shaft and a housing covering at least a lower side of the balancer shaft facing an oil surface of lubricating oil received in an oil pan, the baffle plate includes an edge opposing the housing at a close proximity. Thereby, the connecting portion connecting the control shaft holders with one another substantially entirely separates the controls shaft from the oil surface in cooperation with the balancer housing provided under the crankshaft, the resistance to the engine can be effectively reduced without increasing the number of component parts or the amount of manufacturing work. If the baffle plate further comprises an extension extending from a part adjacent to an end wall of the crankcase to a part adjacent to an opposing part of the balancer shaft housing, the connecting portion and balancer housing can even more completely cover the oil surface of the lubricating oil without increasing the number of component parts or the amount of manufacturing work.

According to a preferred embodiment of the present invention, a passage communicating the interior of a cylinder head with the interior of a crankcase is provided in a side wall of a cylinder block remote from the control shaft. Thereby, the blowby gas and return lubricating oil would not contact the variable stroke piston mechanism so that the blowby gas and return lubricating oil can smoothly flow and an increase in the resistance to the engine owing to the splashing of lubricating oil onto the variable stroke piston mechanism can be avoided. Thus, the present invention is effective in ensuring a smooth flow of blowby gas and return lubricating oil, and preventing the variable stroke piston mechanism from becoming a source of resistance to the engine. Alternatively, the passage communicating the interior of a cylinder head with the interior of a crankcase may be provided in a partition wall of a cylinder block separating adjacent cylinders from each other. In either case, the lubricating oil and blowby gas are prevented from contacting the links, and an increase in the resistance to the movement of the links can be prevented while the structures of the links and passage are prevented from becoming complex.

To minimize the dripping of the return lubricating oil, the engine may consist of an in-line multiple cylinder engine which is tilted toward a side provided with the passage.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
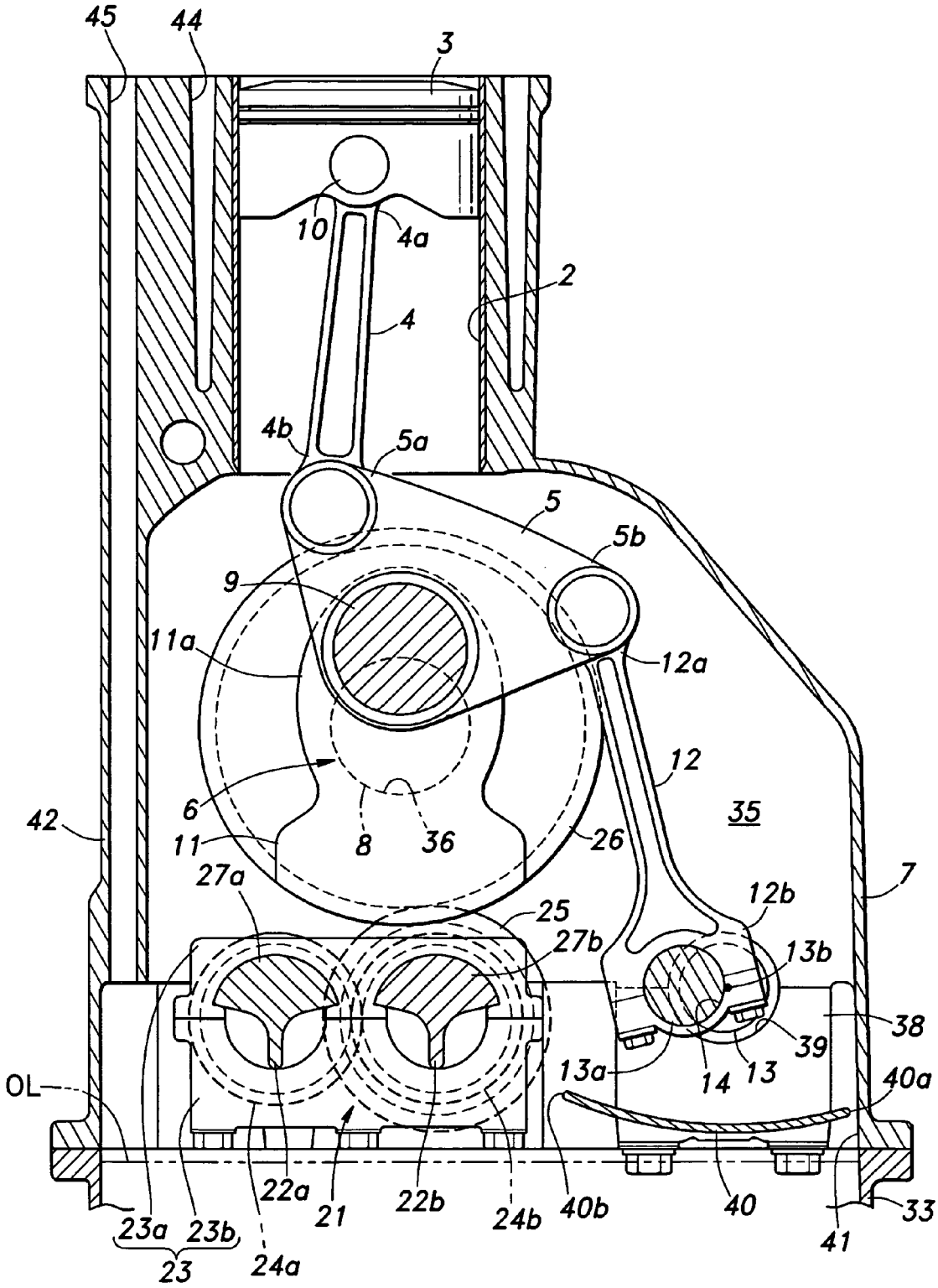
FIG. 1 is a longitudinal sectional view showing an engine embodying the present invention in which the engine is placed in a high compression state and the piston is at the top dead center.

FIG. 1 is a schematic view of a variable stroke engine in the form of a variable compression ratio engine embodying the present invention with the cylinder head and other parts above the cylinder head omitted from the drawing. A cylinder 2 of this engine 1 slidably receives a piston 3 which is connected to a crankshaft 6 via a pair of links consisting of a first link 4 and a second link 5.

The crankshaft 6 is not different from that of a normal fixed compression ratio engine, and supports an intermediate part of the second link 5 which undergoes a rocking motion around a crankpin 9 of the crankshaft 6 offset from a crank journal 8 (rotational center of the crankshaft) supported within a crankcase 7. One end 5*a* of the second link 5 is connected to a big end 4*b* of the first link 4 having a small end 4*a* connected to a piston pin 10. The crankshaft 6 is provided with a counterweight 11 for canceling primarily the primary rotational oscillating component of the piston movement on the other side of the crankpin 9 with respect to the crank journal 8. The counterweight 11 is integrally formed with crank arms 11*a* that join the crank journal 8 with the crank pin 9. The second link 5 retains the crankpin 9 so as to be rotatable around the crankpin 9.

The other end 5*a* of the second link 5 is connected to a small end 12*a* of a third link 12, which is substantially similar to the connecting rod connecting the piston and crankshaft to each other in a conventional engine, via a pin. The big end 12*b* of the third link 12 is provided with a bearing hole 14, consisting of two halves, that is connected to an eccentric portion 13*a* of a control shaft 13 consisting of an eccentric shaft rotatably supported by the crankcase 7 and extending in parallel with the crankshaft 6.

Figure 5:
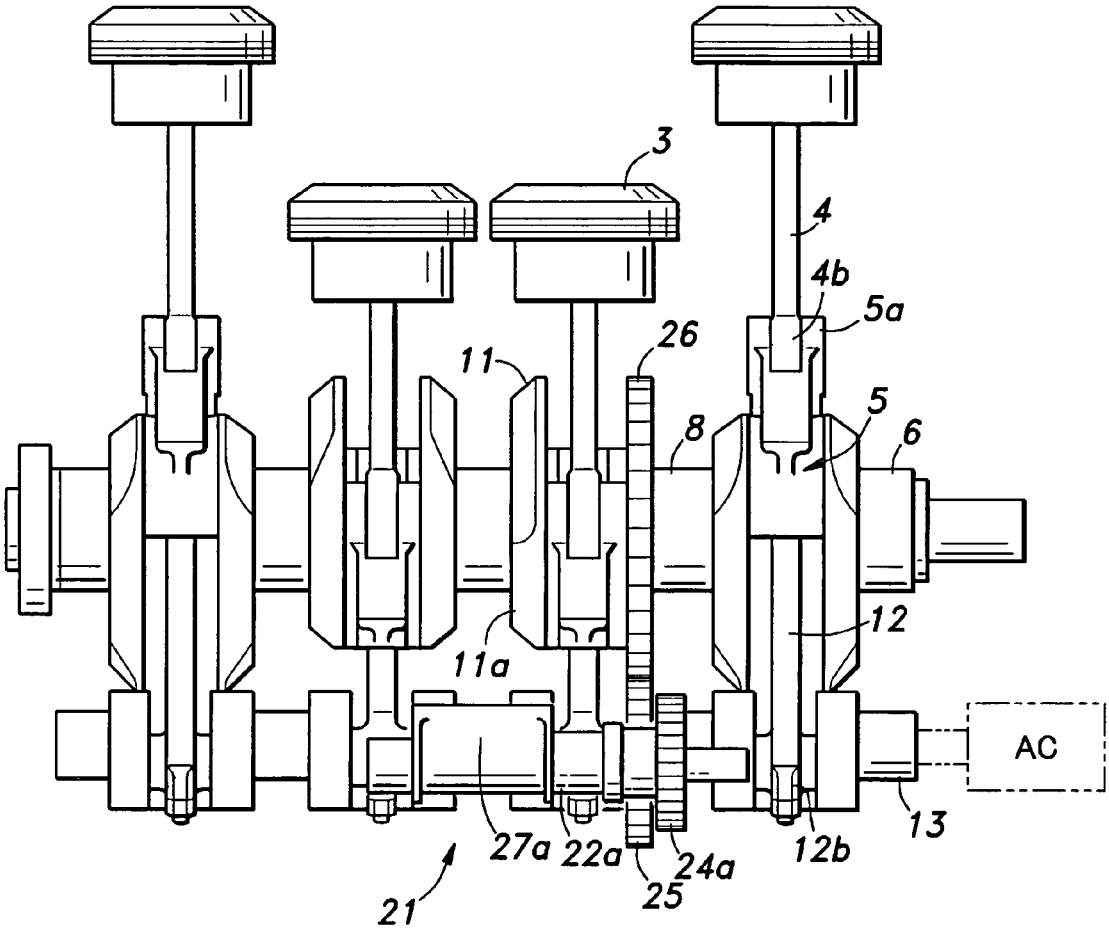
FIG. 5 is a right side view of the internal mechanism of the engine.
Figure 6:
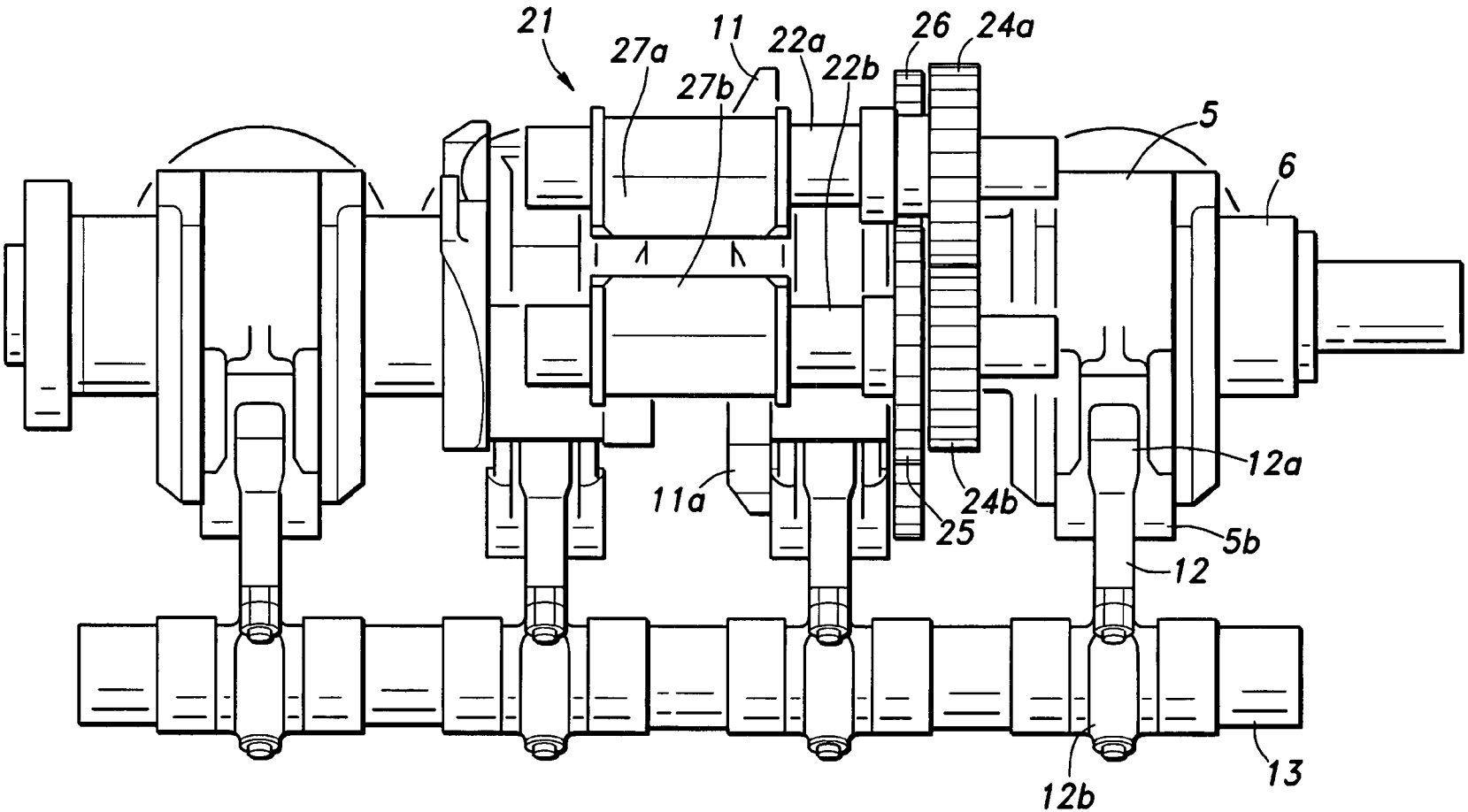
FIG. 6 is a bottom view of the internal mechanism of the engine.

The control shaft 13 supports the big end 12*b* of the third link 12 so as to be moveable within a prescribed range inside the crankcase 7, and a variable stroke property control actuator AC (FIG. 5) provided at an end of the control shaft 13 extending out of the crankcase 7 changes the angular position of the control shaft 13 and retains the control shaft 13 at any angular position depending on the operating condition of the engine 1.

Figure 2:
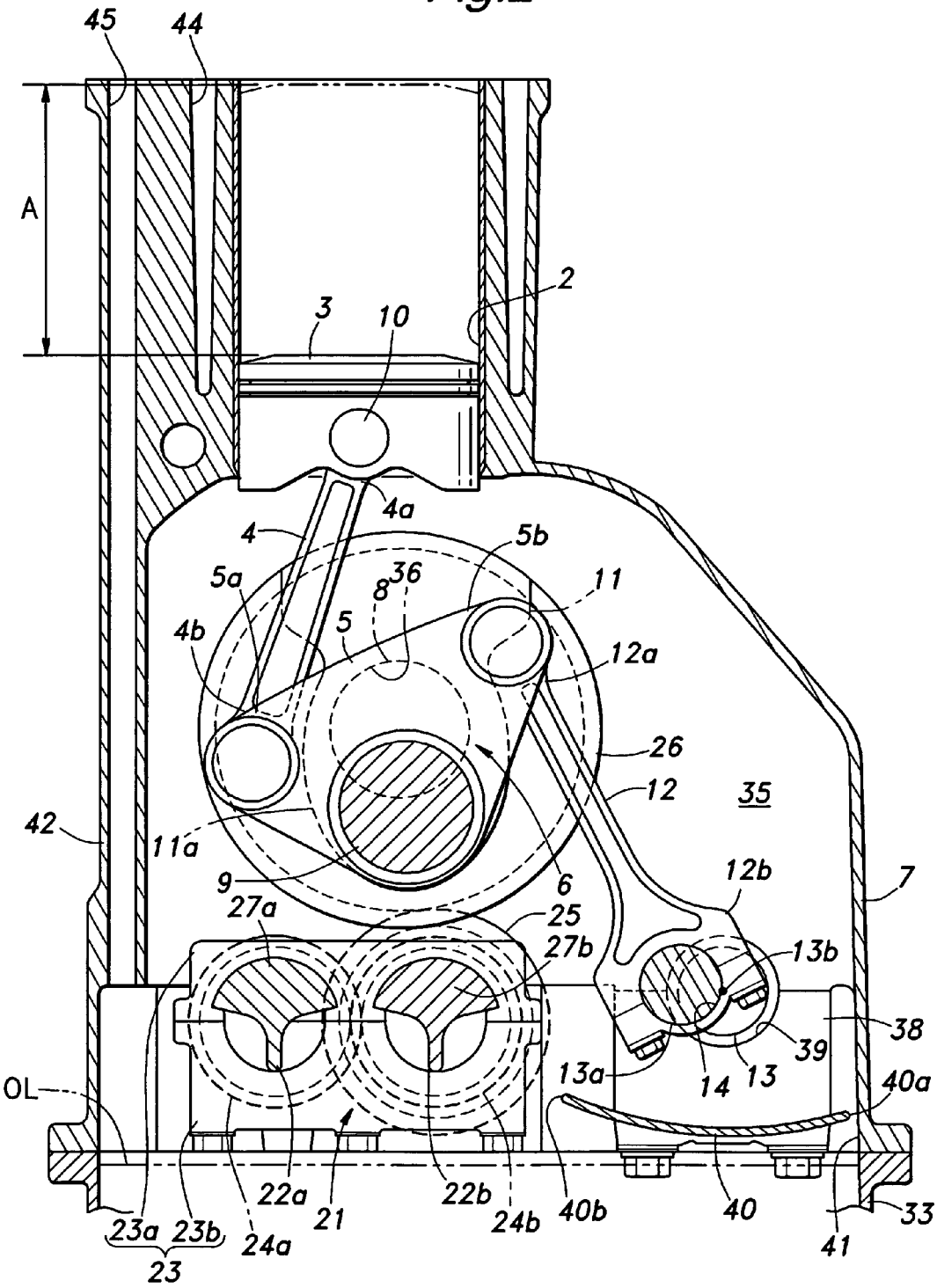
FIG. 2 is a view similar to FIG. 1 when the piston is at the bottom dead center.
Figure 3:
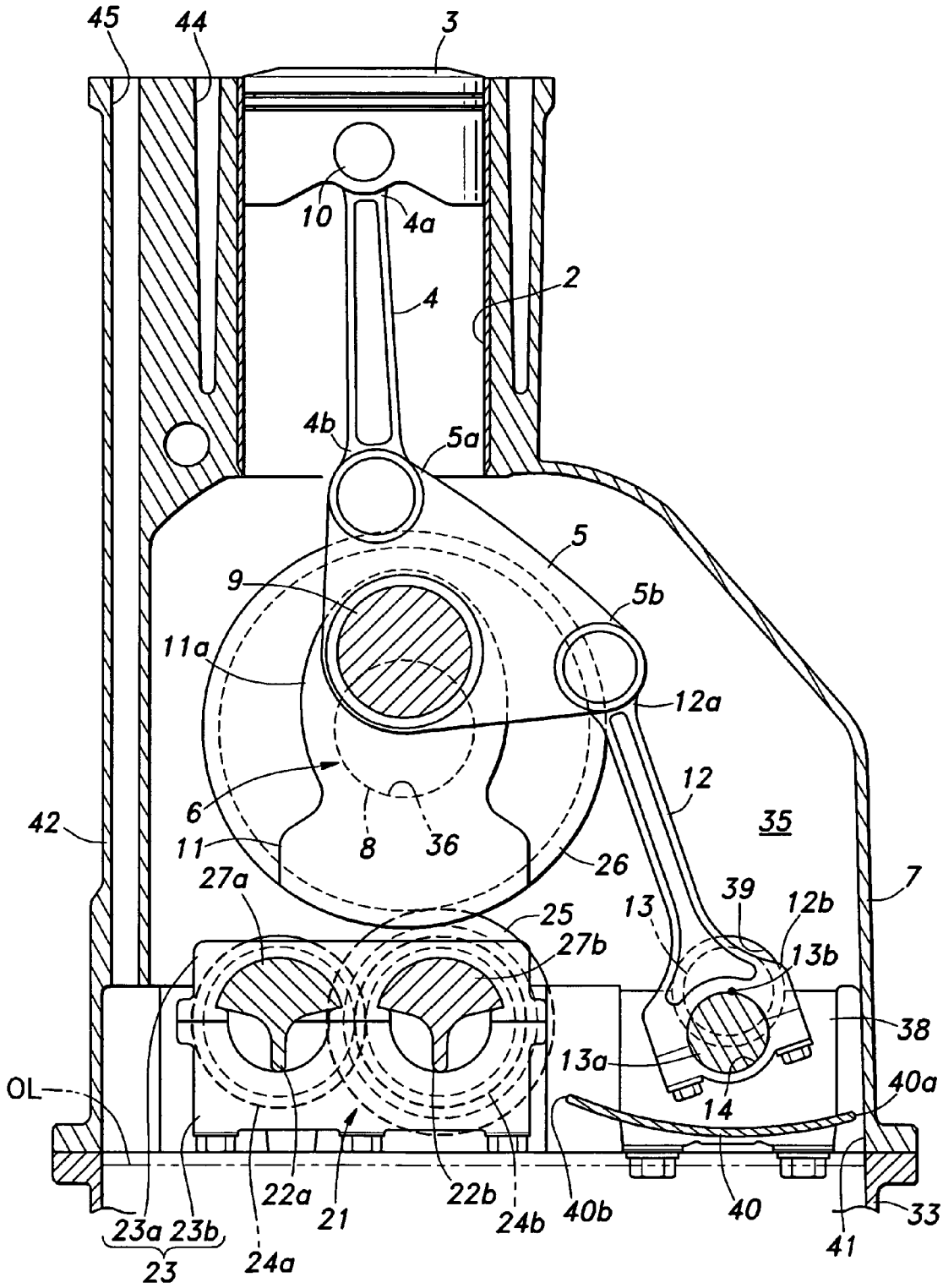
FIG. 3 is a view similar to FIG. 1 when the engine is placed in a low compression state.
Figure 4:
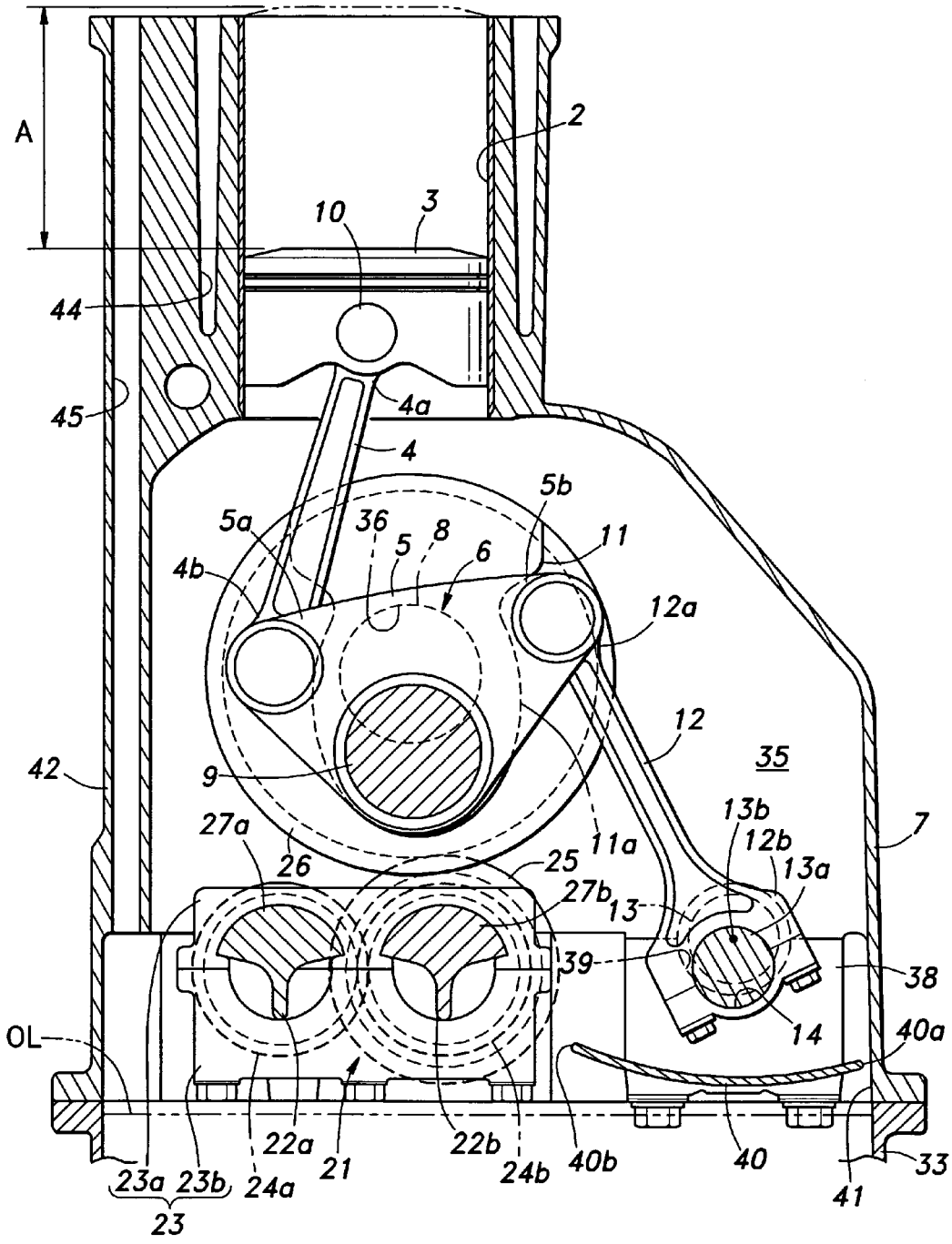
FIG. 4 is a view similar to FIG. 1 when the engine is placed in a low compression state and the piston is at the bottom dead center.

In this engine, by turning the control shaft 13, the position of the big end 12*b* of the third link 12 changes between the position indicated in FIGS. 1 and 2 and the position indicated in FIGS. 3 and 4, and this changes the swinging angle of the second link 5 for a given rotation of the crankshaft 6. The change in the swinging angle of the second link 5 in turn continually changes the stroke of the piston 3 in the cylinder or the top and bottom center positions of the piston 3 between the stroke indicated by A in FIG. 2 and the stroke indicated by B in FIG. 4. In other words, the first to third links 4, 5 and 12 and the control shaft 13 form a variable piston stroke mechanism which provides the function of varying the stroke property of the piston so as to continually change at least one of the compression ratio and the displacement of the engine.

Under the crankshaft 6 of the engine is provided a vibration control device 21 for canceling the rotational secondary vibration produced by the movement of the variable piston stroke mechanism. The vibration control device 21 is provided adjacent to the control shaft 13 which is supported by a part of the crankcase 7 so as to extend inside the crankcase 7 and to be connected with the big end 12*b* of the third link 12.

The vibration control device 21 comprises a pair of balancer shafts 22*a* and 22*b* both extending in parallel with the crankshaft 6 and a housing 23 consisting of upper and lower halves 23*a* and 23*b* that support the balancer shafts 22*a* and 22*b*. The two balancer shafts 22*a* and 22*b* are connected to each other via synchronizing gears 24*a* and 24*b* having an identical diameter and integrally mounted on the corresponding balancer shafts 22*a* and 22*b* so as to mesh with each other. A driven gear 25 provided on one of the balancer shafts 22*b* (the one right under the crankshaft 6) meshes with a drive gear 26 provided on the crankshaft 6 so that the balancer shafts 22*a* and 22*b* may rotate in mutually opposite directions at twice the rotational speed of the crankshaft 6. It is also possible to use a chain/sprocket mechanism as a means for transmitting rotational power from the crankshaft 6 to the balancer shafts 22*a* and 22*b*.

The diameter of the drive gear 26 is equal to the diameter of the circular trajectory of the counterweight 11 which accounts for the greatest diameter of the trajectory of the crankshaft 6 as a whole, and this eliminates restrictions on the layout of the gear mechanism for transmitting the rotational power of the crankshaft to one of the balancer shafts 22*b*. The synchronizing gears 24*a* and 24*b* that synchronize the movements of the balancer shafts 22*a* and 22*b* are provided at an axial position corresponding to the crank journal 8 located between the first and second pistons as counted from the end of the actuator AC in FIG. 5. Because the crank journal 8 is supported by a fixed bearing, the synchronizing gears 24*a* and 24*b* that synchronize the movements of the balancer shafts 22*a* and 22*b* can be arranged freely without the fear of causing any interference with other moving parts.

An outer peripheral part of each balancer shaft 22*a* and 22*b* is provided with a balancer weight 27*a* and 27*b* at a prescribed phase position that has a prescribed amount of inertia mass so as to balance out the movement of the variable piston stroke mechanism. The balancer weights 27*a* and 27*b* are provided at an axial position intermediate between the second and third pistons as counted from the end of the actuator AC in FIG. 5 or at a mid point along the length of the in-line bank of four cylinders in the illustrated embodiment.

The vibration control device 21 is located substantially right under the piston 3 whereas the third link 12 is offset away from the central axial line of the cylinder bank.

The stationary axial line 13*b* of the control shaft 13 is located below the upper end surface of the upper housing 23*a* of the vibration control device 21, and the range of movement of the eccentric portion 13*a* of the control shaft 13 is provided in a part opposing a side wall of the upper housing 22*a*.

Figure 7:
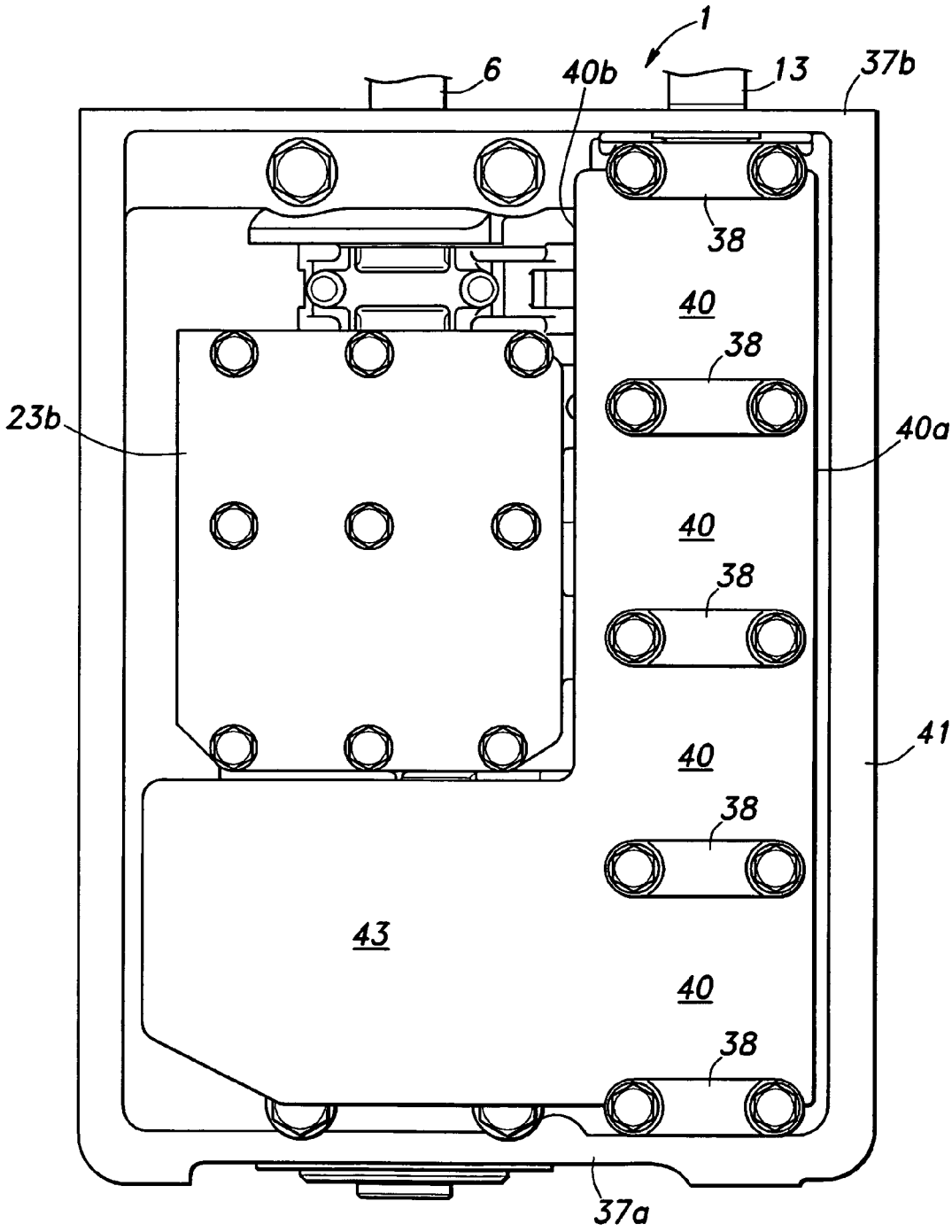
FIG. 7 is a bottom view of an alternate embodiment of the present invention with the oil pan removed.

As shown also in FIG. 7, the control shaft 13 is supported in a lower part of the crankcase 7 by journal holes 39 each consisting of two halves which are formed between the lower surfaces of the end walls of the crankcase 7 and three bulkheads 35 formed in the crankcase 7 so as to separate the cylinders 2 from one another and five bearings caps 38 attached to these lower surfaces.

The five bearing caps 38 are integrally joined one another by a connecting portion 40 extending along the length of the cylinder bank. As illustrated in FIGS. 1 to 4, the connecting portion 40 has a shape of a curved plate having a convex surface that faces downward, and joins the five bearing caps 38 into a single component part.

The connecting portions 40 is located under the control shaft 13, and extends above the oil surface OL of the lubricating oil received in an oil pan 33 which is attached to an open lower end of the crankcase 7. The connecting portions 40 extends laterally toward a side of the balancer housing 23 and a side wall 41 of the crankcase 7 extending along the length of the cylinder bank, and the projecting length toward the side of the balancer housing is greater than that toward the side wall of the crankcase 7. A side edge 40*a* of the connecting portion 40 is close to the inner surface of the side wall 41 of the crankcase 7 while the other side edge 40*b* of connecting portion 40 is close to the side of the balancer housing 23. The connecting portion 40 corresponding to the fourth cylinder is provided with an extension 43 on one side thereof which covers the space between the inner surface of an end wall 37*a* of the crankcase 7 and an axial end surface of the balancer housing 23 so that the connecting portion 40 provided with the extension 43 substantially entirely covers the oil surface OL in cooperation with the balancer housing 23 as shown in FIG. 7.

Because the connecting portion 40 including the extension 43 thereof, substantially entirely covers the oil surface OL in cooperation with the balancer housing 23, even when the oil surface OL is disturbed during the operation of the engine, the variable piston stroke mechanism including the third link 12 and control shaft 13 and the crankshaft 6 would not contact the lubricating oil. Therefore, an increase in the resistance to the engine owing to the contact between the lubricating oil and these moving parts can be favorably avoided.

Figure 8:
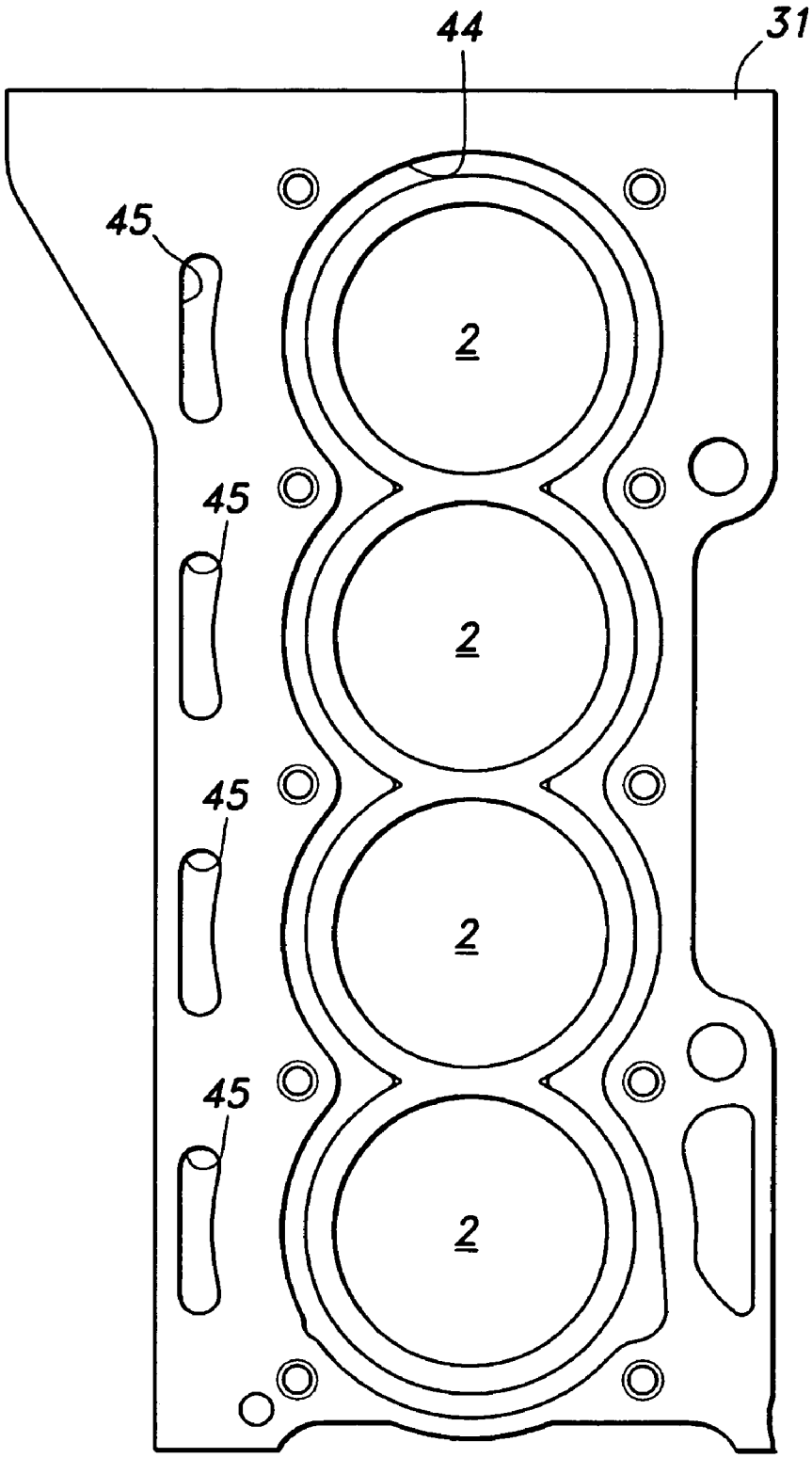
FIG. 8 is a plan view of the cylinder block of the engine of the illustrated embodiment.

The part of the other side wall 42 extending along the length of the cylinder bank of the engine 1 located outside of a water jacket 44 formed around the cylinder is provided with passages 45 for communicating the cylinder head mating surface and the interior of the crankcase 7 as shown in FIG. 8 for the purpose of returning the lubricating oil that has lubricated the valve actuating mechanism (not shown in the drawing) provided within the cylinder head to the oil pan 33 and reducing the pressure pulsation owing to the reciprocating movement of the pistons 3.

These passages 45 are provided on the opposite side of the control shaft 13 with respect to the crankshaft 6, and open out into the crankcase 7 on one side of the balancer housing 23*a* and 23*b*.

Owing to this arrangement, the lubricating oil that drips from the cylinder head is prevented from contacting the variable piston stroke mechanism including the third link 12 and control shaft 13 and the crankshaft 6. Also, the movement of the variable piston stroke mechanism would not obstruct the flow of the blowby gas.

Figure 9:
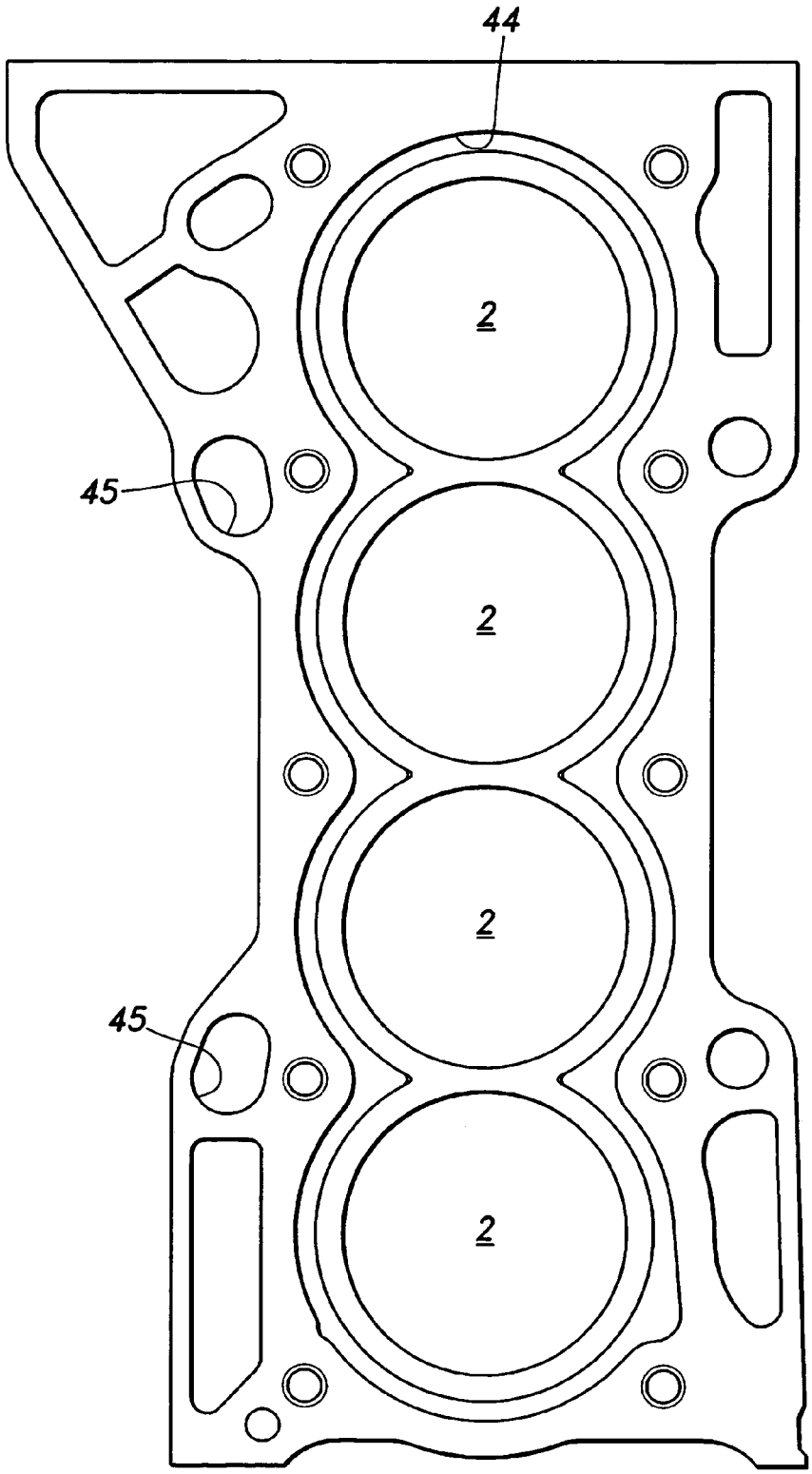
FIG. 9 is a plan view of the cylinder block of an alternate embodiment.

When the engine is mounted on a vehicle with the cylinder axial line tilted to one side, the engine should be tilted in such a manner that the passages 45 may be located in a lower part of the engine so that the dripping of the return lubricating oil may be minimized. These passages 45 may also be provided in bulkheads 35 each of which separates two adjacent cylinders from each other as illustrated in FIG. 9.

Thus, the present invention can be applied to engines that can change at least one of the compression ratio and displacement by changing the geometry of a plurality of links and thereby changing the piston stroke, and in particular to engines having a first link, a second link connected to the first link and a third link connected to a part of the first link at which the second link is connected.

Although the present invention has been described in terms of preferred embodiments thereof, it is obvious to a person skilled in the art that various alterations and modifications are possible without departing from the scope of the present invention which is set forth in the appended claims. The contents of the original Japanese patent applications on which the Paris Convention priority claim is made for the present application are incorporated in this application by reference.

The invention claimed is:

1. A variable stroke property engine comprising a variable piston stroke mechanism including a plurality of links, comprising:

a control shaft supported by a crankcase via a holder for adjusting a position of one of the links; and a baffle plate provided between the links and an oil surface of lubricating oil received in an oil pan;

the baffle plate extending from the holder supporting the control shaft.

2. The variable stroke property engine according to claim 1, further comprising at least a pair of holders for supporting the control shaft, the baffle plate being formed by a connecting portion connecting the holders with each other.

3. The variable stroke property engine according to claim 2, wherein the holders comprise bearing caps.

4. The variable stroke property engine according to claim 2, wherein the control shaft extends in parallel with a crankshaft of the engine.

5. The variable stroke property engine according to claim 3, wherein the connecting portion is provided with a shape of curved plate having a convex surface facing an oil surface of lubricating oil received in an oil pan.

6. The variable stroke property engine according to claim 3, wherein the links include a first link connected to a piston, a second link connecting the first link to a crankshaft and a third link having an end connected to the second link and another end movably supported by the control shaft.

7. The variable stroke property engine according to claim 6, further comprising a balancer shaft and a housing covering at least a lower side of the balancer shaft facing an oil surface of lubricating oil received in an oil pan, the baffle plate includes an edge opposing the housing at a close proximity.

8. The variable stroke property engine according to claim 7, wherein the baffle plate further comprises an extension extending from a part adjacent to an end wall of the crankcase to a part adjacent to an opposing part of the balancer shaft housing.

9. The variable stroke property engine according to claim 6, wherein a passage communicating the interior of a cylinder head with the interior of a crankcase is provided in a side wall of a cylinder block remote from the control shaft.

10. The variable stroke property engine according to claim 9, wherein the engine consists of an in-line multiple cylinder engine and is tilted toward a side provided with the passage.

11. The variable stroke property engine according to claim 6, wherein a passage communicating the interior of a cylinder head with the interior of a crankcase is provided in a partition wall of a cylinder block separating adjacent cylinders from each other.

12. The variable stroke property engine according to claim 11, wherein the engine consists of an in-line multiple cylinder engine and is tilted toward a side provided with the passage.

* * * * *